US009044719B2

(12) United States Patent
Wyczalkowski

(10) Patent No.: US 9,044,719 B2
(45) Date of Patent: Jun. 2, 2015

(54) METHOD AND APPARATUS FOR MIXING

(75) Inventor: Wojciech R. Wyczalkowski, Harrisburg, PA (US)

(73) Assignee: PHILADELPHIA MIXING SOLUTIONS, LTD., King of Prussia, PA (US)

( * ) Notice: Subject to any disclaimer, the term of this patent is extended or adjusted under 35 U.S.C. 154(b) by 562 days.

(21) Appl. No.: 12/339,752

(22) Filed: Dec. 19, 2008

(65) Prior Publication Data

US 2009/0238033 A1 Sep. 24, 2009

Related U.S. Application Data

(60) Provisional application No. 61/016,126, filed on Dec. 21, 2007.

(51) Int. Cl.

| | |
|---|---|
| ***B01F 7/20*** | (2006.01) |
| ***B01F 3/12*** | (2006.01) |
| ***B01F 7/16*** | (2006.01) |
| ***B01F 7/22*** | (2006.01) |

(52) U.S. Cl.
CPC ..... *B01F 3/1221* (2013.01); *B01F 7/1675* (2013.01); *B01F 7/22* (2013.01)

(58) Field of Classification Search
CPC ..... B01F 3/00; B01F 5/00
USPC ..... 366/279, 247, 349, 305, 330.3, 307
See application file for complete search history.

(56) References Cited

U.S. PATENT DOCUMENTS

| | | | | | |
|---|---|---|---|---|---|
| 2,045,919 | A | * | 6/1936 | Parraga | 366/305 |
| 2,793,166 | A | * | 5/1957 | Hatch | 435/289.1 |
| 4,254,699 | A | | 3/1981 | Skinner et al. | |
| 4,358,206 | A | | 11/1982 | Schutte | |
| 4,470,846 | A | * | 9/1984 | Dube | 75/685 |
| 4,747,696 | A | * | 5/1988 | McCrory et al. | 366/307 |
| 4,779,990 | A | * | 10/1988 | Hjort et al. | 366/102 |
| 4,934,828 | A | * | 6/1990 | Janssen | 366/307 |
| 5,080,715 | A | * | 1/1992 | Provencher et al. | 75/708 |
| 5,198,156 | A | * | 3/1993 | Middleton et al. | 261/87 |
| 5,451,349 | A | * | 9/1995 | Kingsley | 261/91 |
| 5,711,902 | A | * | 1/1998 | Hsu | 261/91 |
| 5,762,417 | A | * | 6/1998 | Essen et al. | 366/264 |
| 5,865,534 | A | * | 2/1999 | Hay | 366/2 |
| 6,109,449 | A | * | 8/2000 | Howk et al. | 209/169 |
| 6,158,722 | A | * | 12/2000 | Gigas | 261/84 |
| 6,241,221 | B1 | * | 6/2001 | Wegner et al. | 261/93 |
| 6,250,796 | B1 | * | 6/2001 | Huang | 366/270 |
| 6,467,947 | B1 | | 10/2002 | Welsh | |

(Continued)

*Primary Examiner* — Joseph S Del Sole
*Assistant Examiner* — Nahida Sultana
(74) *Attorney, Agent, or Firm* — Baker & Hostetler LLP

(57) ABSTRACT

An apparatus and method for mixing a liquid having particulate includes a vessel for containing the liquid and an axial impeller rotating about a substantially vertical axis. The impeller is adapted for submerging below the liquid surface by a distance approximately one-quarter to one-half of the height of the liquid. The impeller is oriented upwardly to produce (a) an inner, upward flow region located along the vertical axis of the vessel, (b) a transition flow region above the impeller in which liquid moves radially outwardly toward the vessel sidewall, and (c) an outer, downward flow region located along the sidewall. The impeller spins at a variable speed, such that the flow is capable of entraining solid particles having a settling velocity of up to approximately 1 foot per minute in the liquid, and the speed of the impeller is chosen to enable particles having a desired settling velocity to settle to the vessel bottom.

25 Claims, 3 Drawing Sheets

(56) References Cited

U.S. PATENT DOCUMENTS

| | | | | |
|---|---|---|---|---|
| 6,467,974 | B1 * | 10/2002 | Ebimoto et al. | 396/419 |
| 6,896,246 | B2 * | 5/2005 | Weetman et al. | 261/84 |
| 7,168,849 | B2 * | 1/2007 | Adams | 366/270 |
| 7,427,058 | B2 * | 9/2008 | Galletta, Jr. | 261/91 |
| 8,152,357 | B2 * | 4/2012 | Artusi | 366/140 |
| 8,550,695 | B2 * | 10/2013 | Conti | 366/205 |
| 8,721,165 | B2 * | 5/2014 | Conti | 366/205 |
| 2004/0062144 | A1 * | 4/2004 | Hultholm et al. | 366/317 |
| 2004/0188334 | A1 * | 9/2004 | McWhirter et al. | 210/219 |
| 2004/0234435 | A1 | 11/2004 | Bickham et al. | |
| 2005/0007874 | A1 * | 1/2005 | Roszczenko et al. | 366/270 |
| 2006/0176771 | A1 * | 8/2006 | Adams | 366/270 |
| 2006/0180948 | A1 | 8/2006 | Howk et al. | |
| 2006/0263201 | A1 * | 11/2006 | Harman | 415/72 |
| 2008/0025144 | A1 * | 1/2008 | Kocienski et al. | 366/270 |
| 2008/0101156 | A1 * | 5/2008 | Yatomi et al. | 366/316 |
| 2009/0035856 | A1 * | 2/2009 | Galliher et al. | 435/383 |
| 2009/0207689 | A1 * | 8/2009 | Artusi | 366/140 |
| 2009/0263309 | A1 * | 10/2009 | McCutchen et al. | 423/447.1 |
| 2009/0287033 | A1 * | 11/2009 | Strauss et al. | 585/714 |
| 2009/0323464 | A1 * | 12/2009 | McIntire | 366/168.1 |
| 2011/0261644 | A1 * | 10/2011 | Gigas et al. | 366/293 |
| 2011/0272836 | A1 * | 11/2011 | Keegan et al. | 264/5 |
| 2014/0083918 | A1 * | 3/2014 | Nguyen et al. | 210/150 |

* cited by examiner

METHOD AND APPARATUS FOR MIXING

CROSS-REFERENCE TO RELATED APPLICATIONS

This application claims priority to provisional U.S. patent application No. 61/016,126, filed Dec. 21, 2007, the contents of which are incorporated herein by reference in their entirety.

FIELD OF THE INVENTION

The present invention relates to a method and apparatus for mixing liquids, particularly a method and apparatus for mixing liquids with solid particles.

BACKGROUND OF THE INVENTION

Mixing vessels may be used in a variety of industrial applications. They may be used as precipitators in alumina production, anaerobic digesters in waste water treatment, and in many other applications. For example, in alumina production, two predominant mixing technologies may typically be used: draft tube mixers and mechanical agitators with impellers on very long shafts.

Draft tube mechanical mixers typically provide vertical circulation of suspended solid particles by having a pumping impeller inside of the tube that reaches deep into the mixing vessel. The vessel and draft tube usually are free of obstructions, or alumina may precipitate on the vessel walls in zones of low flow velocity. In order to prevent this scaling on the interior of the vessel walls, the vessels are typically equipped with baffles. Unfortunately, these baffles prevent inhibit or prevent rotation of the liquid inside the vessel.

Even with baffles on the interior of the vessel walls, precipitate may eventually build up on the baffles and vessel walls. Such precipitator vessels must be periodically taken off-line for cleaning of alumina deposits. If the vessel is not cleaned often enough, the weight of the precipitated material may cause the collapse of the internal baffle structures. However, cleaning often causes disruption to production cycles, and it may be costly.

Also, draft tube precipitators typically must be operated at high flow velocities to minimize precipitate build-up on the baffles. Therefore, the impeller blade speed must also be high, and that may result in high erosion rates at the impeller blade tips. Eroded impeller blades may require frequent impeller replacement.

As an alternative to draft tube mixers, mixers with long impeller shafts (which may submerge the impeller blades far below the liquid surface) may also be used. These vessels are sometimes operated without baffles, because the mixer may induce a predominantly swirling flow with a small radial velocity component. Therefore, the propensity for scaling at the vessel wall is minimized, but due to low turbulence in the vessel center, crystals may precipitate on the slowly-rotating impeller shaft and impeller blades. This build-up may require periodically taking the vessel off-line for cleaning of precipitate deposits on the impeller assembly.

Another method of mixing liquids and solids is described in U.S. Pat. No. 6,467,947. This mixing apparatus contains a short impeller shaft and radial impeller blades, with the impeller blades located adjacent to the surface of the liquid. The rotational motion of the impeller blades induces a swirling motion in the vessel allowing for suspension of solid particles. However, the use of radial impeller blades may make particle suspension inefficient, from an energy standpoint. Also, this method may require a high mixer speed, which may cause significant erosion of the impeller blades.

The present invention may provide a mixing apparatus and method for continuous mixing in a vessel that minimizes vessel wall and impeller assembly precipitate build-up with limited impeller blade erosion for longer service between maintenance activities.

SUMMARY OF THE INVENTION

An apparatus for mixing a liquid having particulate includes a vessel for containing the liquid. The vessel includes a sidewall and a bottom. An axial impeller rotates about a substantially vertical axis and is adapted for submerging below the liquid surface by a distance that is approximately one-quarter to one-half of the height of the liquid, and oriented upwardly to produce (a) an inner, upward flow region located along the vertical axis, (b) a transition flow region located above the impeller in which liquid moves radially outwardly toward the vessel sidewall, and (c) an outer, downward flow region located along the sidewall. The impeller is variable speed such that the flow is capable of entraining solid particles having a settling velocity of up to approximately 1 foot per minute in the liquid and the speed of the impeller is chosen to enable particles having a desired settling velocity to settle to the vessel bottom.

Also disclosed is a method of mixing a liquid having particulate that includes the steps of: providing a vessel for containing the liquid, the vessel including a sidewall and a bottom, and providing an axial impeller rotating about a substantially vertical axis, the axial impeller being adapted for submerging below the liquid surface by a distance that is approximately one-quarter to one-half of the height of the liquid, oriented upwardly to produce (a) an inner, upward flow region located along the vertical axis, (b) a transition flow region located above the impeller in which liquid moves radially outwardly toward the vessel sidewall, and (c) an outer, downward flow region located along the sidewall, and being variable speed, such that the flow is capable of entraining solid particles having a settling velocity of up to approximately 1 foot per minute in the liquid and the speed of the impeller is chosen to enable particles having a desired settling velocity to settle to the vessel bottom.

A method of mixing a liquid is disclosed, including the steps of: providing a liquid in vessel having an upper end, a lower end, and a substantially cylindrical containing wall extending between the upper and lower ends; providing an axial impeller rotating about a substantially vertical axis, the axial impeller having a means for adjusting the rotational speed and being submerged in the liquid to a position that is located approximately one-quarter to one-half of the distance from the upper end to the lower end; and producing a flow in the liquid with the axial impeller, the flow comprising (a) an inner flow along the vertical axis, moving from the lower end toward the upper end, (b) an outward flow from the axial impeller toward the containing wall, and (c) an outer flow along the containing wall, moving from the upper end toward the lower end.

The apparatus and methods may also include a vessel having a sidewall height to diameter ratio of at least 3 and/or a bottom that is conical in shape and having a slope of at least 45 degrees. The impeller may be submerged. The flow preferably is continuous. The vessel may also include a baffle extending longitudinally along the vessel sidewall approximately from the liquid surface to the axial impeller.

The drawbacks of the prior art and advantages of particular embodiments are provided for context, and the present invention is not limited to the problems or solutions explained or implicitly provided herein. Aspects of the invention are illustrated in the embodiments shown herein, and the present invention is not limited to the particular embodiments, but rather is intended to be broadly interpreted according to the full breadth of the claims.

DETAILED DESCRIPTION OF ILLUSTRATIVE EMBODIMENTS

Figure 1:
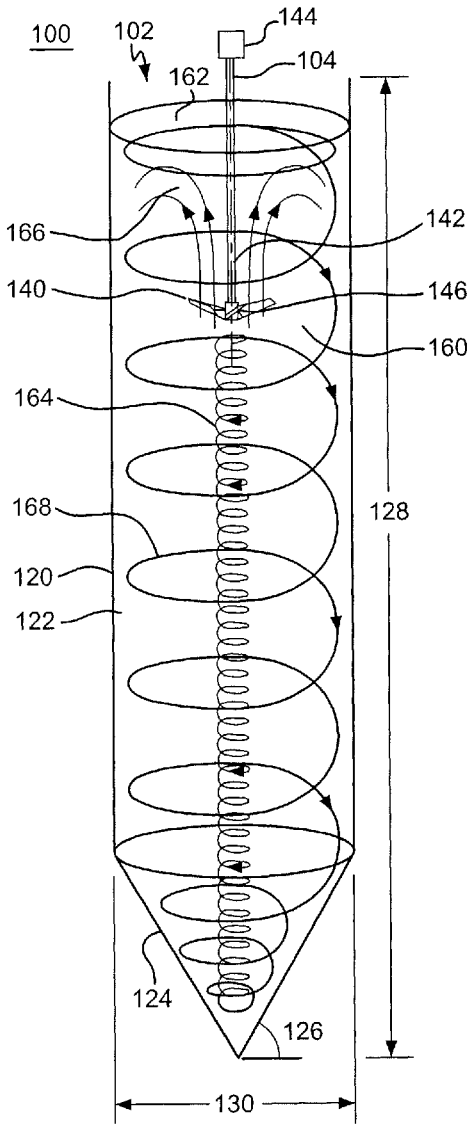
FIG. 1 is a diagrammatic view of an apparatus for mixing illustrating the orientation of the liquid flow regions.

Referring to FIG. 1 to illustrate a preferred structure and function of the present invention, a mixing assembly 100 includes a vessel assembly 102 and an impeller assembly 104. Vessel assembly 102 includes a vessel sidewall 120 and a vessel bottom 124, and defines a vessel height 128 and a vessel diameter 130. Vessel sidewall 120 includes a vessel sidewall inside surface 122. Vessel bottom 124 includes a slope 126. Impeller assembly 104 includes impeller blades 140, an impeller shaft 142, a mechanical drive 144, and (optionally) a hub 146.

Within vessel assembly 102, a liquid 160, as best shown in FIG. 1, includes a liquid surface 162, an upward flow region 164, a transition flow region 166, and a downward flow region 168. The particles, if present within vessel assembly 102, include suspended particles 106 and precipitated particles 108. The particles, as best shown in FIG. 2, define upward particle movement region 200, a transition particle movement region 202, a downward particle movement region 204, and a large particle collection region 206.

In an exemplary embodiment, a mixing assembly was designed allowing lifting and suspension of suspended particles 106 of alumina, up to approximately sixty-three (63) microns in size, which, in this embodiment, was equivalent to suspended particles 106 of alumina having a settling velocity in the liquid 160 of up to approximately 1 foot per minute. As used herein and in the claims, the term "settling velocity" means the vertical-axis component of the velocity at which a suspended particle, having a density greater then the surrounding liquid or solution, and that is large enough to precipitate out of the liquid or solution, moves towards the bottom of the mixing vessel. Generally, in a given liquid, larger particles may be expected to have a higher settling velocity than smaller particles of the same density. Also, generally, particles of a given size suspended in liquids having a lower density or viscosity may be expected to have a higher settling velocity than particles suspended in liquids having a higher density or viscosity. Accordingly, particles larger than the suspended particles (that is, precipitated particles 108) drop out towards the vessel bottom 124 and may be available for removal. The size and geometry of vessel assembly 102 and the size, speed, and configuration of impeller assembly 104 may be chosen according to conventional sizing criteria in view of the present disclosure and the desired application (including liquid and particle properties). Accordingly, the components of the mixing system may be chosen, and once chosen may be operated, to achieve precipitation of a desired particle size. The present invention has been demonstrated to achieve lifting and suspension of 63 micron particles and particles having a settling velocity of up to approximately 1 foot per minute, and the present invention is not limited to this particle size or settling velocity unless explicitly recited in the claims, as the present invention encompasses lifting and suspension of any large or small particle sizes or particles having any low or high settling velocity.

Vessel assembly 102 preferably is cylindrical in shape (with a circular cross section), and it may have any vessel height 128 and any vessel diameter 130. Preferably, the vessel height 128 is at least three (3) times the value of the vessel diameter 130. The particular dimensions may be chosen according to well known design principles according to the parameters of the liquid(s), particulate, and purpose of the desired application. The vessel sidewall 120 and vessel bottom 124 may be made of any material, including, but not limited to, stainless steel. Vessel sidewall 120 and vessel bottom 124 may also be made of any other material known in the relevant art. Vessel sidewall 120 may be attached to vessel bottom 124 in any way, including, but not limited to welding, riveting, or any other method known in the relevant art.

Figure 2:
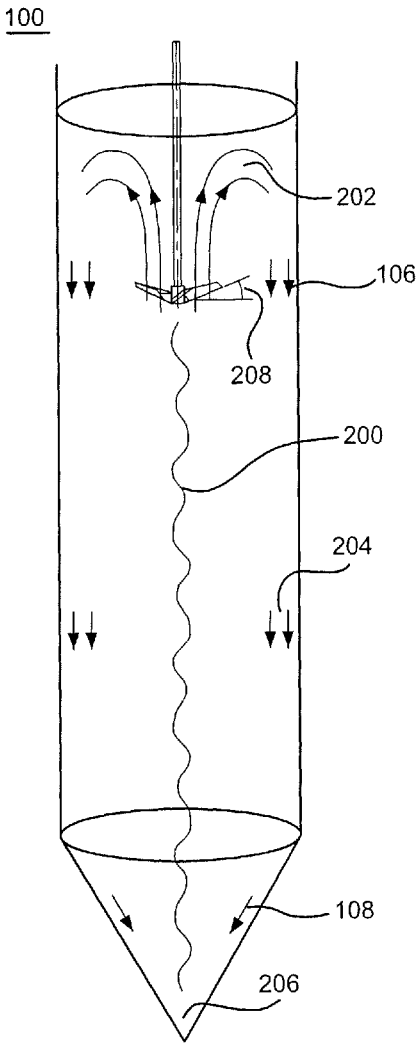
FIG. 2 is another diagrammatic view of the apparatus of FIG. 1 illustrating the movement of particles within the liquid flow regions.
Figure 3:
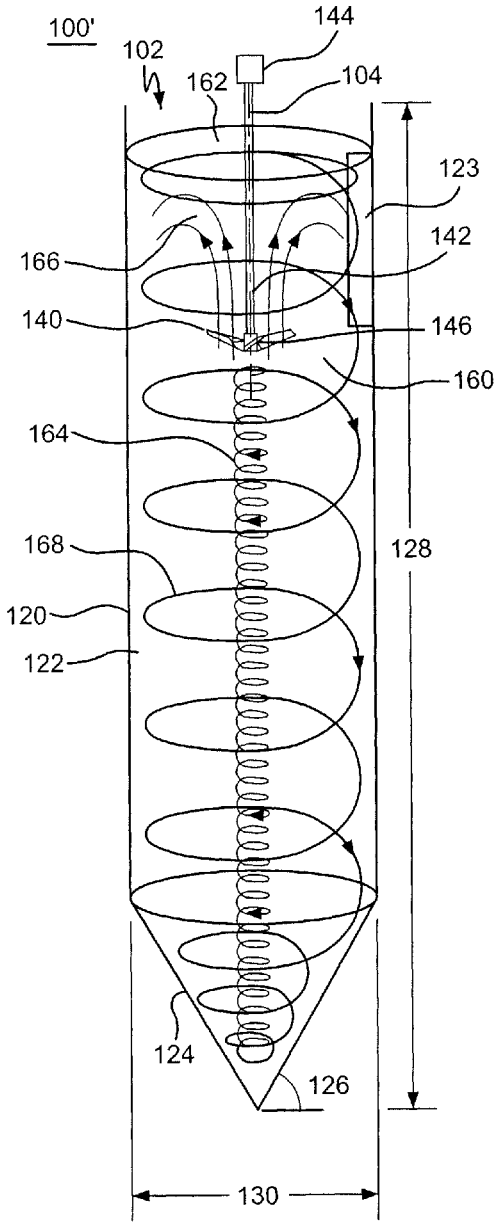
FIG. 3 is a diagrammatic view of an apparatus for mixing including a baffle, illustrating another embodiment of the invention.
Figure 4:
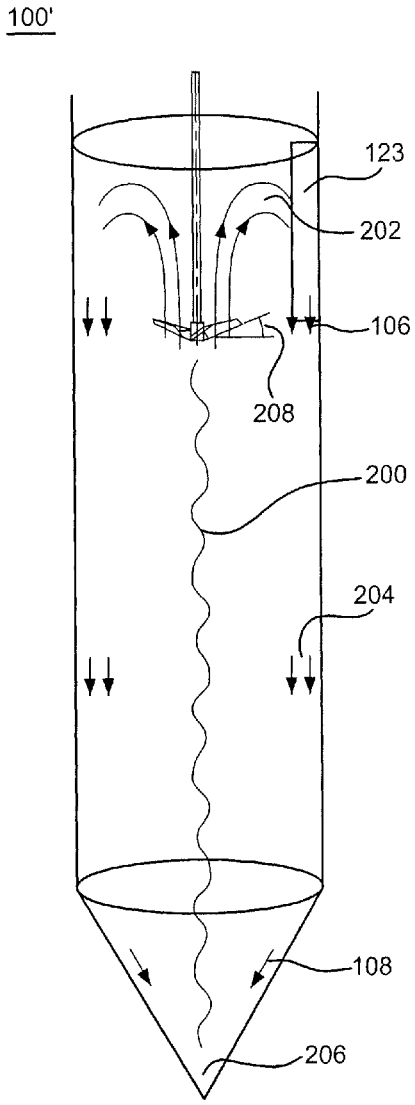
FIG. 4 is another diagrammatic view of the apparatus of FIG. 3 illustrating the movement of particles within the liquid flow regions.

In the embodiment shown in FIGS. 1 and 2, vessel sidewall inside surface 122, and all other parts of vessel assembly 102, does not have baffles. The lack of baffles may help prevent scaling from building up on vessel sidewall inside surface 122. The present invention is not, of course, limited to vessels that lack baffles. For example, FIGS. 3 and 4 show a mixing assembly 100' including a vessel assembly 102 having a baffle 123. Baffle 123 may extend radially inward any distance from vessel sidewall 120. Preferably, baffle 123 extends radially inward from vessel sidewall 120 to a distance that is between ⅛ and 1/20 of vessel diameter 130, more preferably extending to a distance that is approximately 1/12 of vessel diameter 130. Baffle 123 may extend longitudinally any distance along vessel sidewall 120. Preferably, baffle 123 extends longitudinally along vessel sidewall 120 approximately from liquid surface 162 to impeller blades 140. While not being bound by theory, the presence of baffle 123 in mixing assembly 100' may help limit the speed of rotation of downward flow region 168 to a desired level, which may improve the particle lifting capacity (e.g., ability to keep larger particles 106 or particles 106 having a higher settling velocity suspended in liquid 160) of mixing assembly 100'.

Vessel assembly 102 may be of any volume that is appropriate for use as a precipitator for suspended particles 106. In one exemplary embodiment, precipitators for alumina were designed with vessel assembly 102 volumes of approximately 17 gallons, 20 gallons, 500 gallons, 30,000 gallons, 60,000 gallons, and 140,000 gallons. In another embodiment, coal slurry mixers were designed with vessel assembly 102 volumes of approximately 5 gallons, 100 gallons, and 6 million gallons.

The vessel bottom may be of any shape. In the preferred embodiment shown in the figures, the vessel bottom 124 is conical in shape and has a vessel bottom slope 126 of at least forty-five (45) degrees. In embodiments in which the vessel bottom is conical, vessel bottom slope 126 may be any angle, including zero degrees (flat), between zero and forty-five degrees, or greater than forty-five degrees.

Figure 5:
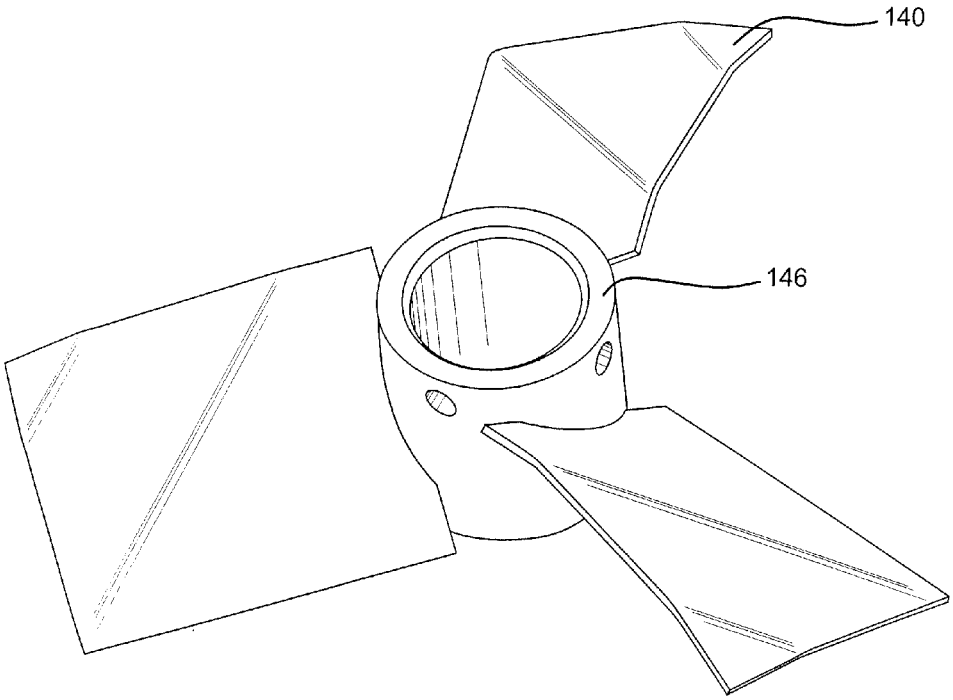
FIG. 5 is a perspective view of an impeller that may be used in an embodiment of the present invention.

Impeller assembly 104 may contain any number of blades 140, which may be of any material, including stainless steel or any other material known to those in the pertinent art. Preferably, as shown in FIG. 5, there are three impeller blades 140. The present invention contemplates any impeller, any number of impeller blades, and impeller blades of any length and configuration. The length of impeller blades 140 shown in FIG. 5 may be scaled up or down, depending on the dimensions of vessel assembly 102, the desired size of suspended particles 106, and other process and dimension parameters.

Impeller blades 140 may be pitched (rotated) at any angle to a plane that is perpendicular to the rotational axis of impeller assembly 104. This pitch angle allows the impeller to move fluid and gas in an axial and radial direction. In one exemplary embodiment, the impeller blades 140 are pitched at approximately a thirty-nine (39) degree angle from a plane that is perpendicular to the rotational axis of impeller assembly 104. In this embodiment, a Philadelphia Mixing Solutions 3 MHS39 impeller, which is shown in FIG. 5, is used. The impeller blades may be pitched at angles from approximately thirty (30) to approximately seventy-five (75) degrees.

The impeller blades 140 may have any rake angle 208 (rotated towards the rotational axis of impeller assembly 104), shown in FIG. 2, to a plane that is perpendicular to the rotational axis of impeller assembly 104. The axis about which the rake angle is measured is perpendicular to the axis about which the pitch angle is measured, and both the rake angle and pitch angle axes are perpendicular to the rotational axis of impeller assembly 104. In one exemplary embodiment, the impeller blades 140 have a rake angle of approximately thirty-nine (39) degrees from a plane that is perpendicular to the rotational axis of impeller assembly 104. In other embodiments, the impeller blades 140 have a rake angle from approximately thirty (30) to approximately seventy-five (75) degrees. The outer surface of impeller blades 140 may be flat, or it may be curved, for example, as in an airfoil design. Preferably, as shown in FIG. 5, the outer surface of impeller blades 140 is shaped with two simple bends at the blade tips to approximate a hydrofoil design. In another embodiment, the outer surface of impeller blades 140 is curved in a hydrofoil shape.

Impeller blades 140 are of an axial impeller design, in which liquid 160 may be drawn upwards towards and through impeller blades 140. With many impeller designs contemplated by the present invention, some of liquid 160 may, of course, be propelled through radially. Impeller blades 140 are connected to the lower end of impeller shaft 142 and spaced approximately at equidistant radial locations about impeller shaft 142. Impeller blades 140 may be contained in a one-piece assembly for attachment to the lower end of impeller shaft 142, or they may be individually attached to the lower end of impeller shaft 142.

In one exemplary embodiment, the torque transmitted by mechanical drive 144 to impeller shaft 142 is transmitted from the shaft to a hub 146. Hub 146 may be welded to impeller shaft 142, or it may incorporate a keyway or set screw to prevent rotation of hub 146 relative to impeller shaft 142. In another exemplary embodiment, hub 146 incorporates welded or casted ears for attachment of impeller blades 140 to hub 146. In other embodiments, impeller blades 140 are welded or bolted to hub 146. The lower end of impeller shaft 142 may protrude below impeller blades 140, reaching a lower depth in liquid 160 than the blades.

Mechanical drive 144 may be any mechanical drive known in the pertinent art that may be adapted to rotate impeller shaft 142 and impeller blades 140 to the desired speed, such as a gear box, a belt drive, and the like. Mechanical drive 144 is coupled to the upper end of impeller shaft 142.

Use of an axial pumping impeller assembly 104 may make possible suspension of suspended particles 106 for particles up to 63 microns in size or for particles having a settling velocity of up to approximately 1 foot per minute. By varying the rotational speed of the axial impeller assembly 104, the lifting forces for solid suspended particles 106 may be changed. By adjusting these lifting forces, this may allow suspension of suspended particles 106 of desired sizes or having desired settling velocities only. This may allow the mixing apparatus to be used to classify particle sizes or settling velocities.

Liquid 160 may be any carrier medium for suspended particles 106, according to the particular process to which the present invention is employed. Liquid surface 162 is the highest point that liquid 160 reaches in vessel assembly 102. In one preferred embodiment, impeller blades 140 are submerged one-third (⅓) of the distance from liquid surface 162 to vessel bottom 124. In other embodiments, impeller blades 140 are submerged to distances between one-quarter (¼) to one-half (½) of the distance from liquid surface 162 to vessel bottom 124. Impeller blades 140 may also be submerged to other depths, depending on the desired flow characteristics of liquid 160 in vessel assembly 102.

Liquid 160 includes an upper flow region 164, a transition flow region 166, and a downward flow region 168. The upward flow region 164 may have both an axial (upward, substantially along the axis of impeller shaft 142) and tangential (rotating substantially about the axis of impeller shaft 142) velocity component to its motion. Liquid 160 moves through upward flow region 164 towards the impeller blades 140. In one preferred embodiment, the velocity of the center of upward flow region 164 is higher than at the outer edges of upward flow region 164, in both the axial component and the tangential component of the velocity. The relationship between the velocity of various portions of upward flow region 164 may vary, depending on the dimensions of vessel assembly 102 and impeller assembly 104, as well as the rotational speed of impeller blades 140.

The transition flow region 166 may have axial, tangential, and radial (moving from the center of vessel assembly 102 towards the vessel sidewall 120) velocity components. As can be seen in FIG. 1, liquid 160 may have velocity components in an arc, moving upwards towards liquid surface 162 and outwards towards vessel sidewall 120.

The downward flow region 168 may have axial, tangential, and radial velocity components to its motion. In one preferred embodiment, the velocity of the center of downward flow region 168 is higher than at the outer edges of downward flow region 168, in both the axial component and the tangential component of the velocity. The relationship between the velocity of various portions of downward flow region 168 may vary, depending on the dimensions of vessel assembly 102 and impeller assembly 104, as well as the rotational speed of impeller blades 140. The entire downward flow region 168 may move in a fast, tangential motion, moving about the impeller shaft axis, while at the same time moving downward. This rapid tangential and axial motion in downward flow region 168 may help to reduce or eliminate scaling at the vessel sidewall 120.

In an exemplary embodiment, a method and apparatus are provided for suspending and classifying solid particles up to approximately 63 microns in size or having settling velocities of up to approximately 1 foot per minute, in tall cylindrical vessels, using an axial up-pumping impeller, and equipped with a conical vessel bottom.

In this exemplary embodiment, axial impeller blades 140 are submerged in liquid 160 and centrally located in the upper half of liquid 160, in a vessel assembly 102 with a vessel height 128 to vessel diameter 130 ratio greater than three (3).

In this exemplary embodiment, the rotation of impeller assembly 104 may produce three velocity components of flow in the fluid 160: axial, radial, and tangential. The radial flow velocity component is caused by the impeller rotation, and this flow may move the fluid 160 through the transition flow region 166, towards the vessel sidewall 120. The axial flow velocity component may help to move the fluid 160 from the vessel bottom 124, through the upward flow region 164, towards the impeller blades 140. The tangential flow velocity component causes rotation of the entire body of fluid 160 in vessel assembly 102, about a central vertical axis that is substantially coincident with the impeller shaft 142 rotational axis.

The motion of fluid 160 may reach a steady state condition, in which the tangential flow motion that is induced by the impeller assembly 104 produces an upward tornado-like effect in upward flow region 164. In this embodiment, the tangential angular velocity of the fluid 160 in upward flow region 164 may be greater than the tangential angular velocity in the downward flow region 168 at the vessel sidewall 120. Also, the fluid in upward flow region 164 may have an axial velocity component that exceeds the axial velocity component in downward flow region 168. This phenomenon makes it possible to lift solid suspended particles 106 from the vessel bottom 124 towards the transition flow region 166 and the liquid surface 162.

Suspended particles 106 are carried throughout upward flow region 164, transition flow region 166 and downward flow region 168, while suspended in liquid 160. Generally, suspended particles 106 follow the same velocity vectors as the portions of liquid 160 in which they are suspended. The suspended particles 106 are carried upward by the motion of liquid 160 in upward particle movement region 200, in a substantially axial direction, towards the impeller blades 140. After passing above the impeller blades 140, the suspended particles 106 are carried in transition particle movement region 202 towards the vessel sidewall 120. Once the suspended particles 106 reach downward flow region 168, they are carried in downward particle movement region 204 until they reach the vessel bottom 124. If the suspended particles 106 have grown to a size that may allow them to precipitate out of the liquid 160, they may become precipitated particles 108, which collect at the vessel bottom 124 in the large particle collection region 206. Once precipitated particles 108 settle in the large particle collection region 206, these particles may be removed from mixing assembly 100, preferably by conventional means, to be used for other industrial purposes.

In an exemplary embodiment, suspended particles 106 begin to settle downward in downward particle movement region 204, near vessel sidewall inside surface 122. These precipitated particles 108 collect in vessel bottom 124, which preferably has a conical shape. If the precipitated particles 108 are smaller than the desired size, the particles are lifted again in upward particle movement region 200 and become suspended particles 106. This lifting and precipitating process may repeat until the precipitated particles 108 are at least the desired size, and they remain in the large particle collection region 206 near the vessel bottom 124.

In an exemplary embodiment of a crystallizer, in which the mixing process causes the size of suspended particles 106 to increase during mixing, larger precipitated particles 108 oscillate only in the large particle collection region 206 near the vessel bottom 124. The lifting force available to lift the precipitated particles 108 into upward particle movement region 200 depends on the rotational speed of the impeller assembly 104. Therefore, changing the rotational speed of the impeller assembly 104 makes it possible to discharge from mixing assembly 100 only precipitated particles 108 of at least the desired size.

In one exemplary embodiment, the flow of liquid 160, suspended particles 106, and precipitated particles 108 is continuous. Continuous flow entails liquid 160, suspended particles 106, and precipitated particles 108 being periodically, regularly, or constantly being added and removed from vessel assembly 102. In other embodiments, the flow of liquid 160, suspended particles 106, and precipitated particles 108 is not continuous.

In an exemplary embodiment of a waste digester, methane or other gas bubbles may be produced during the flow of liquid 160, and these gas bubbles may be collected at and/or above liquid surface 162. The flow characteristics of liquid 160 allow gas bubbles to condense into the center of liquid 160, in upward flow region 164. These condensed gas bubbles are then released to liquid surface 162, where they can be collected. This condensation of gas bubbles prevents the formation of froth at liquid surface 162, which allows for more easy collection of the gas.

In an exemplary embodiment of wastewater treatment, the instant invention can be used to mix liquids and gasses containing up to approximately three percent (3%) suspended sludge (by weight).

The foregoing description is provided for the purpose of explanation and is not to be construed as limiting the invention. While the invention has been described with reference to preferred embodiments or preferred methods, it is understood that the words which have been used herein are words of description and illustration, rather than words of limitation. Furthermore, although the invention has been described herein with reference to particular structure, methods, and embodiments, the invention is not intended to be limited to the particulars disclosed herein, as the invention extends to all structures, methods and uses that are within the scope of the appended claims. Those skilled in the relevant art, having the benefit of the teachings of this specification, may effect numerous modifications to the invention as described herein, and changes may be made without departing from the scope and spirit of the invention as defined by the appended claims.

What is claimed:

1. A method of mixing a liquid having particulate, comprising the steps of:

in a vessel for containing the liquid, the vessel including a sidewall, a bottom, and a baffle extending longitudinally along the sidewall approximately from the liquid surface, such that a lower end of the baffle is located in a zone defined as below the liquid surface by a distance that is approximately one-quarter to one-half of the height of the liquid;

rotating an axial impeller about a substantially vertical axis, said axial impeller:

being submerged below the liquid surface in the zone defined by the distance that is approximately one-quarter to one-half of the height of the liquid, and there is no impeller outside the zone;

oriented upwardly to produce (a) an inner, upward flow region located along said vertical axis, (b) a transition flow region located above the impeller in which liquid moves radially outwardly toward the vessel sidewall, and (c) an outer, downward flow region located along the sidewall; and being variable speed.

2. The method of claim 1, wherein the ratio of the vessel sidewall height to the vessel diameter is at least 3.

3. The method of claim 1, wherein the vessel bottom is conical and has a slope of at least 45 degrees.

4. The method of claim 1, wherein said axial impeller and the lower end of the baffle are adapted for being located approximately the same distance below the liquid surface.

5. The method of claim 1, wherein the flow is continuous.

6. The method of claim 1, wherein the baffle extends longitudinally along the vessel sidewall approximately from the liquid surface to the axial impeller.

7. A method of mixing a liquid comprising the steps of:

in a liquid in a vessel having an upper end, a lower end, and a substantially cylindrical containing wall extending between the upper and lower ends, and having a baffle having an upper end and a lower end;

rotating an axial impeller about a substantially vertical axis, said axial impeller having a means for adjusting the rotational speed and being submerged in said liquid to a position that is located approximately one-quarter to one-half of the distance from said upper end to said lower end;

thereby producing a central vortex flow in the liquid with the axial impeller, said flow comprising (a) an inner flow along said vertical axis, moving from the lower end toward the upper end, (b) an outward flow from the axial impeller toward the containing wall, and (c) an outer flow along the containing wall, moving from the upper end toward the lower end, the baffle defining a region of restricted rotational flow region above the impeller and an unbaffled, unrestricted rotational flow region below the lower end of the baffle.

8. The method of claim 7, wherein said axial impeller is submerged in said liquid to a position that is located approximately one-third of the distance from said upper end to said lower end.

9. The method of claim 8 wherein the baffle extends longitudinally along the vessel sidewall such that a lower end of the baffle and the axial impeller are located below the liquid surface by approximately the same distance.

10. The method of claim 9, wherein the ratio of the vessel sidewall height to the vessel diameter is at least 3.

11. The method of claim 9, wherein the vessel bottom is conical and has a slope of at least 45 degrees.

12. The method of claim 9, wherein the flow is continuous.

13. The method of claim 1, wherein the flow is capable of entraining solid particles having a settling velocity of up to approximately 1 foot per minute in the liquid and the speed of the impeller is chosen to enable particles having a desired settling velocity to settle to the vessel bottom.

14. The method of claim 9, wherein the baffle extends approximately from the liquid surface such that the lower end of the baffle is located below the liquid surface by a distance that is approximately one-quarter to one-half of the height of the liquid.

15. The method of claim 14, wherein the entire vessel wall below the lower end of the baffle is unbaffled.

16. The method of claim 14, wherein the flow is capable of entraining solid particles having a settling velocity of up to approximately 1 foot per minute in the liquid and the speed of the impeller is chosen to enable particles having a desired settling velocity to settle to the vessel bottom.

17. A method of mixing a liquid comprising the steps of:

in a liquid in a vessel having an upper end, a lower end, and a substantially cylindrical containing wall extending between the upper and lower ends, and having a baffle having an upper end and a lower end;

rotating an axial impeller about a substantially vertical axis, said axial impeller having a means for adjusting the rotational speed and being submerged in said liquid to a position that is located in a zone defined by approximately one-quarter to one-half of the distance from said upper end to said lower end, and there is no impeller outside the zone;

thereby producing a flow in the liquid with the axial impeller, said flow comprising (a) an inner flow along said vertical axis, moving from the lower end toward the upper end, (b) an outward flow from the axial impeller toward the containing wall, and (c) an outer flow along the containing wall, moving from the upper end toward the lower end, the baffle defining a region of restricted rotational flow region above the impeller and an unbaffled, unrestricted rotational flow region below the lower end of the baffle.

18. The method of claim 17, wherein said axial impeller and the lower end of the baffle are adapted for being located approximately the same distance below the liquid surface.

19. The method of claim 17, wherein the flow is continuous.

20. The method of claim 17, wherein said axial impeller is submerged in said liquid to a position that is located approximately one-third of the distance from said upper end to said lower end.

21. The method of claim 17, wherein the flow is capable of entraining solid particles having a settling velocity of up to approximately 1 foot per minute in the liquid and the speed of the impeller is chosen to enable particles having a desired settling velocity to settle to the vessel bottom.

22. A method of mixing a liquid having particulate, comprising the steps of:

in a vessel for containing the liquid, the vessel including a sidewall, a bottom, and a baffle extending longitudinally along the sidewall approximately from the liquid surface, such that a lower end of the baffle is located below the liquid surface by a distance that is approximately one-quarter to one-half of the height of the liquid;

rotating an axial impeller about a substantially vertical axis, said axial impeller:

being submerged below the liquid surface by a distance that is approximately one-quarter to one-half of the height of the liquid;

oriented upwardly to produce (a) an inner, upward flow region located along said vertical axis, (b) a transition flow region located above the impeller in which liquid moves radially outwardly toward the vessel sidewall, and (c) an outer, downward flow region located along the sidewall, such that the flow includes a central vortex; and being variable speed.

23. The method of claim 22, wherein said axial impeller and the lower end of the baffle are located approximately the same distance below the liquid surface.

24. The method of claim 22, wherein the flow is continuous.

25. The method of claim 22, wherein the flow is capable of entraining solid particles having a settling velocity of up to approximately 1 foot per minute in the liquid and the speed of the impeller is chosen to enable particles having a desired settling velocity to settle to the vessel bottom.

* * * * *